US005303827A

United States Patent [19]

Ross

[11] Patent Number: 5,303,827

[45] Date of Patent: Apr. 19, 1994

[54] PLASTIC BAG DRYING RACK

[76] Inventor: Sheila M. Ross, 271 N. Vine Ave., Rialto, Calif. 92376

[21] Appl. No.: 18,156

[22] Filed: Feb. 16, 1993

[51] Int. Cl.[5] ..... A47F 7/00

[52] U.S. Cl. ..... 211/13; 248/311.3

[58] Field of Search ..... 211/13, 33; 248/311.3; 34/239, 220

[56] References Cited

U.S. PATENT DOCUMENTS

| | | | |
|---|---|---|---|
| 894,203 | 7/1908 | Harvey | 211/33 X |
| 1,886,752 | 11/1932 | Stansberry | 211/33 |
| 5,080,237 | 1/1992 | Hefner | 211/311.3 X |
| 5,121,842 | 6/1992 | Osborne | 211/33 |
| 5,188,244 | 2/1993 | Holstegge | 211/13 X |

*Primary Examiner*—Alvin G. Chin-Shue
*Assistant Examiner*—Sarah A. Lechok
*Attorney, Agent, or Firm*—Leon Gilden

[57] ABSTRACT

A rack structure arranged to accommodate a plurality of plastic type sandwich bags and the like is provided to permit the drying of the bags in an opened configuration to permit the sanitizing and drying thereof for their reuse. The rack structure includes a plurality of semicircular arcuate support rods arranged for reception within a respective bag to permit the bags to be maintained in an extended opened configuration to enhance their drying.

3 Claims, 3 Drawing Sheets

PLASTIC BAG DRYING RACK

BACKGROUND OF THE INVENTION

1. Field of the Invention

The field of invention related to drying apparatus, and more particularly pertains to a new and improved plastic bag drying rack wherein the same is arranged to maintain a plurality of bags in an opened configuration to permit their drying and sanitizing.

2. Description of the Prior Art

Drying apparatus of various types are utilized throughout the prior art to support structure in a drying procedure. Such apparatus has heretofore been typically of a rack structure of generic construction to support a variety of various components thereon. The instant invention attempts to overcome deficiencies of the prior art by providing for a rack structure specifically directed to the support of bag members, and particularly plastic bag members of polyethelene film to support the bags in an opened configuration to permit their drying and in this respect, the present invention substantially fulfills this need.

SUMMARY OF THE INVENTION

In view of the foregoing disadvantages inherent in the known types of drying apparatus now present in the prior art, the present invention provides a plastic bag drying rack wherein the same is arranged to position a plurality of bags in an extended and opened configuration to permit the sanitizing and drying of the bag structures. As such, the general purpose of the present invention, which will be described subsequently in greater detail, is to provide a new and improved plastic bag drying rack which has all the advantages of the prior art drying apparatus and none of the disadvantages.

To attain this, the present invention provides a rack structure arranged to accommodate a plurality of plastic type sandwich bags and the like to permit the drying of the bags in an opened configuration to permit the sanitizing and drying thereof for their reuse. The rack structure includes a plurality of semi-circular arcuate support rods arranged for reception within a respective bag to permit the bags to be maintained in an extended opened configuration to enhance their drying.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved plastic bag drying quickly rack which has all the advantages of the prior art drying apparatus and none of the disadvantages.

It is another object of the present invention to provide a new and improved plastic bag drying rack which may be easily and efficiently manufactured and marketed.

It is a further object of the present invention to provide a new and improved plastic bag drying rack which is of a durable and reliable construction.

An even further object of the present invention is to provide a new and improved plastic bag drying rack which is susceptible of a low cost of manufacture with regard to both materials and labor, and which accordingly is then susceptible of low prices of sale to the consuming public, thereby making such plastic bag drying racks economically available to the buying public.

Still yet another object of the present invention is to provide a new and improved plastic bag drying rack which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
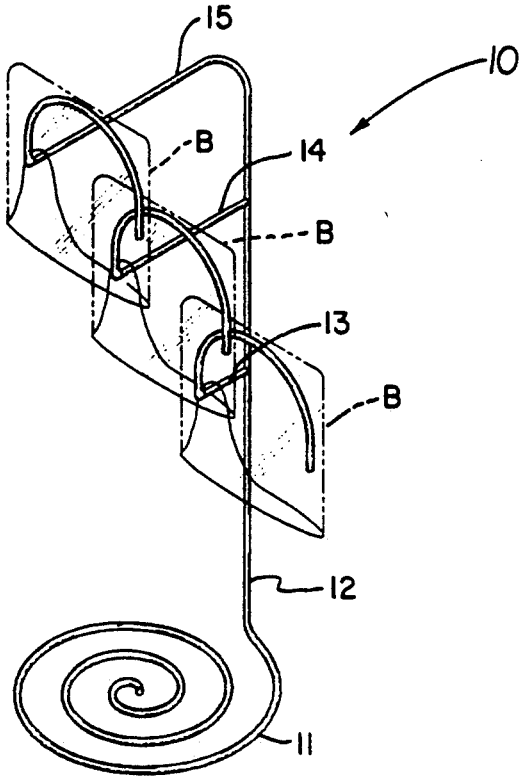
FIG. 1 is an isometric illustration of the invention indicating the mounting of plastic bags in a drying procedure.
Figure 2:
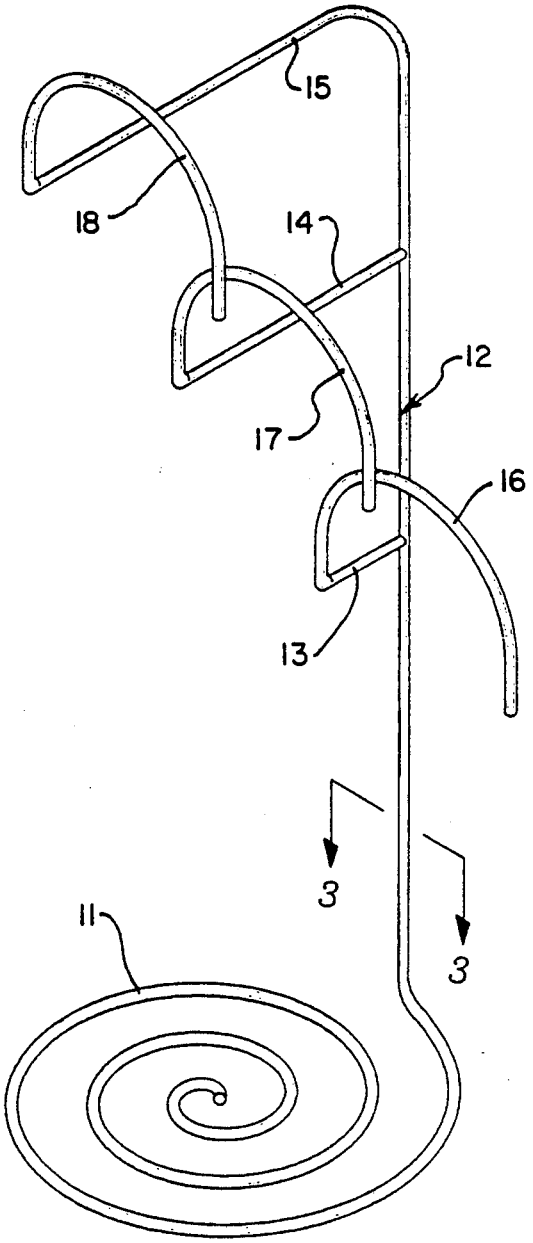
FIG. 2 is an isometric illustration, somewhat enlarged, of the apparatus of the invention.
Figure 3:
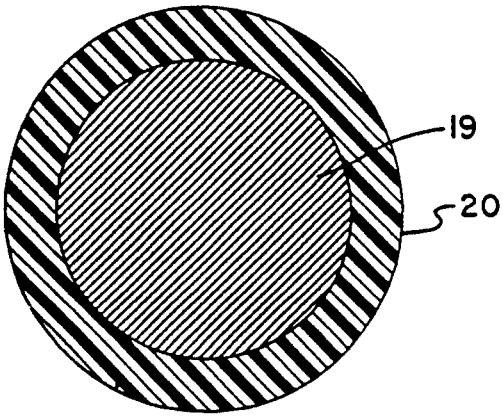
FIG. 3 is an orthographic view, taken along the lines 3—3 of FIG. 2 in the direction indicated by the arrows.
Figure 4:
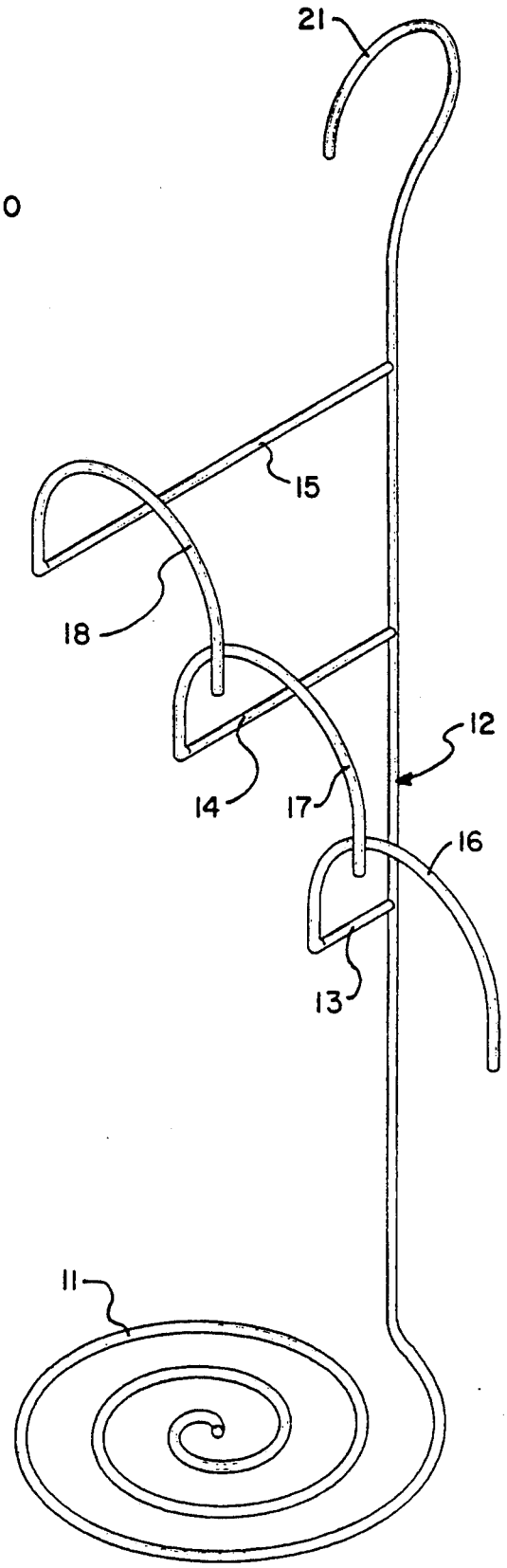
FIG. 4 is an isometric illustration of the invention indicating the use of a semi-circular head mounted to an upper distal end of the rack structure to support a further bag member.

With reference now to the drawings, and in particular to FIGS. 1 to 6 thereof, a new and improved plastic bag drying rack embodying the principles and concept of the present invention and generally designated by the reference numerals 10 and 10*a* will be described.

More specifically, the plastic bag drying rack 10 of the instant invention essentially comprises a spiral base 11, having a support tube 12 fixedly and orthogonally extending relative to the spiral base, with the support tube arranged typically of a deformable material to permit the angular repositioning of the support tube, if desired. Respective first, second, and third rigid support rods 13, 14, and 15 are fixedly and orthogonally mounted to the support tube 12 in a spaced parallel relationship relative to one another, having respective first, second, and third semi-circular rack rods 16, 17 and 18 mounted to the respective first, second, and third support rods 13, 14, and 15, with each of the rack rods having a convex exterior surface and a concave interior surface, with each concave interior surface arranged in facing relationship relative to the base 11 permitting the rack rods to each support a polymeric bag member "B", as indicated in FIG. 1, to support the bags in a convenient and sanitary manner for the drying and reuse of such bag structure. The FIG. 3 indicates the use of a central malleable cord 19, having a polymeric sheath 20 thereabout for the support tube 12. Further, the FIG. 4 indicates the further positioning of a semi-circular head 21 fixedly mounted to an upper distal end of the support tube 12 for supporting a further bag member "B" thereon, having the semi-circular head including a concave surface in facing relationship relative to the base 11. Further, in lieu of the base 11, a suction cup 22 may be employed if desired as an option, but it is understood that the suction cup base indicated in the apparatus 10*a* of FIG. 5 is arranged as an example of a base structure, wherein the structure of FIG. 5 may indeed include the spiral base structure 11.

Figure 5:
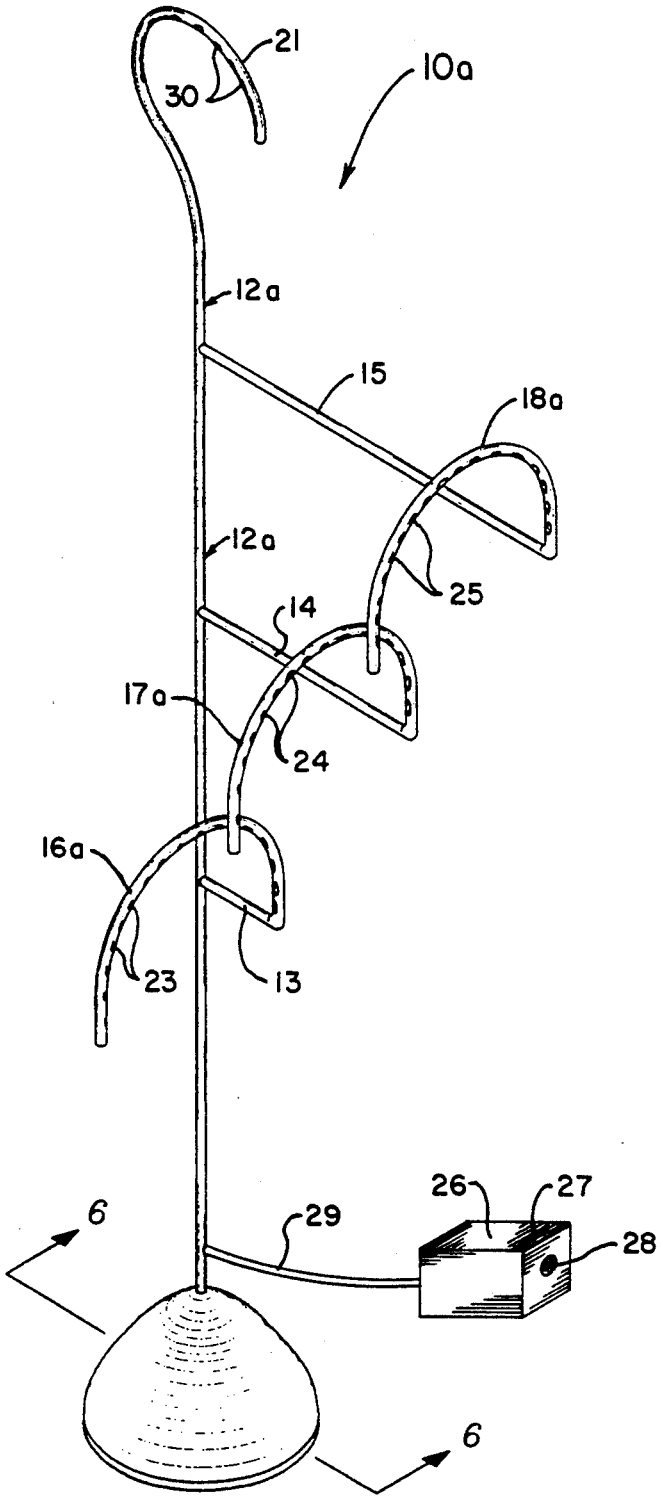
FIG. 5 is an isometric illustration of a modified aspect of the invention.
Figure 6:
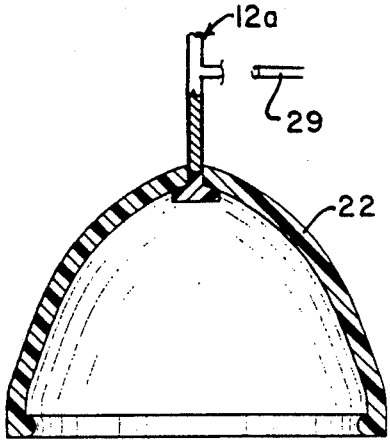
FIG. 6 is an orthographic view, taken along the lines 6—6 of FIG. 5 in the direction indicated by the arrows.

The apparatus 10*a*, as indicated in FIG. 5, includes modified first, second, and third semi-circular rack rods 16*a*, 17*a*, and 18*a*, each of a tubular construction in pneumatic communication with a tubular support tube 12*a*, as indicated in FIG. 6. The first, second, and third modified rack rods 16*a*, 17*a*, and 18*a* each employ a respective first, second, and third semi-annular array of respective first, second, and third apertures 23, 24, and 25. Further, the semi-circular head 21 includes a semi-annular array of fourth apertures 30 for enhanced drying of bag members "B" positioned upon the head structure of the invention. Further, each of the array of apertures is directed into the concave surface of each of the heads to direct drying and blowing air through the open end of each bag to enhance directing of moisture from within each bag and enhance sanitizing minimizing time availed for accumulation of mold and the like within each bag structure and to further minimize time required in a drying procedure. To this end, a blower motor 26 is provided, having an on/off switch 27 and an air inlet 28 to direct pneumatic pressure through a pneumatic pressure hose 29 from the blower motor 26 into the modified tubular support 12*a*, and subsequently through the respective first, second, third, and fourth semi-annular array of apertures 23, 24, 25, and 30.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A plastic bag drying rack, comprising, a base, the base having a support tube fixedly mounted to the base in an orthogonal relationship, and the support tube including a first, second, and third rigid support rod integrally and orthogonally mounted to the support tube, with the first, second, and third support rods arranged in a parallel spaced relationship, with the first support rod including a first semi-circular rack rod fixedly mounted to the first support rod, a second semi-circular rack rod mounted to the second support rod, and a third semi-circular rack rod mounted to the third support rod, with each semi-circular rack rods including a concave surface and a convex surface, with each concave surface arranged in a facing relationship relative to the base.

2. A plastic bag drying rack as set forth in claim 1 wherein the support tube includes a semi-circular head mounted to an uppermost distal end of the support tube, wherein the semi-circular head includes a head concave surface and a head convex surface, and the head concave surface is arranged in a facing relationship relative to the base to support a further bag member thereon.

3. A plastic bag drying rack as set forth in claim 2 wherein the support tube is tubular, and wherein the first semi-circular rack rod is tubular, the second semi-circular rack rod is tubular, the third semi-circular rack rod is tubular, and the semi-circular head is tubular, each in pneumatic communication with the support tube, and a blower motor having an on/off switch and a pneumatic pressure hose in pneumatic communication with the blower motor, and in pneumatic communication with the tube to direct pressurized air into the support tube and into the first rack rod, the second rack rod, the third rack rod, and the semi-circular head, with the first rack rod including a semi-annular array of first apertures, the second rack rod having a semi-circular array of second apertures, the third rack rod having a semi-circular array of third apertures, and the semi-circular head having a semi-annular array of fourth apertures, wherein each semi-annular array of apertures are directed through each concave surface.

* * * * *